United States Patent [19]

Abercrombie et al.

[11] 4,136,849

[45] Jan. 30, 1979

[54] APPARATUS FOR MANUFACTURING CONCRETE BUILDING SECTIONS

[75] Inventors: James C. Abercrombie, 177 Alison Rd., Thamesford, Ontario; James D. Pinchin, 199 Commissioners Rd., E. London, Ontario, both of Canada; Jack J. Van Loon, Thamesford, Canada

[73] Assignees: James Carman Abercrombie, Thamesford; James Davis Pinchin, E. London, both of Canada

[21] Appl. No.: 818,342

[22] Filed: Jul. 22, 1977

Related U.S. Application Data

[63] Continuation-in-part of Ser. No. 623,030, Oct. 16, 1975, abandoned.

[30] Foreign Application Priority Data

Sep. 11, 1975 [CA] Canada ..... 235282

[51] Int. Cl.[2] ..... E04G 11/06

[52] U.S. Cl. ..... 249/18; 249/154; 249/160

[58] Field of Search ..... 249/189, 154, 1, 13, 249/18, 50, 51, 105, 119, 160, 207, 188, 129, 98, 99, 101; 425/808, 88, 62, 63, 64, 256, 257, 258, 447, DIG. 106, 111, 219

[56] References Cited

U.S. PATENT DOCUMENTS

| | | | |
|---|---|---|---|
| 785,578 | 3/1905 | Sawyer | 249/129 |
| 1,219,080 | 3/1917 | Case | 249/101 X |
| 1,305,704 | 6/1919 | Evers | 249/101 |
| 1,891,764 | 12/1932 | Henderson | 425/209 X |
| 2,495,100 | 1/1950 | Henderson | 425/DIG. 106 |
| 2,623,446 | 12/1952 | Clark et al. | 425/64 X |
| 2,745,138 | 5/1956 | Beattie | 249/119 X |
| 2,968,082 | 1/1961 | Schutze et al. | 425/447 X |
| 3,089,217 | 5/1963 | Filippi | 425/447 X |
| 3,108,518 | 10/1963 | O'Connor | 425/64 X |
| 3,605,195 | 9/1971 | Campbell | 425/808 |
| 3,703,271 | 11/1972 | Kamb et al. | 249/154 X |

*Primary Examiner*—J. Howard Flint, Jr.

*Attorney, Agent, or Firm*—Burns, Doane, Swecker & Mathis

[57] ABSTRACT

This invention relates to an apparatus for producing a plurality of large curved concrete building sections of uniform thickness. The apparatus includes a number of forms having a concrete core and a steel casing and being of a generally crescent shaped cross-section. The forms are aligned in face to face relationship and attached together by means of end pieces to form molds. Concrete is then introduced into the molds by a ready-mix concrete truck driving on top of the assembly. After the poured concrete has hardened the forms and end pieces are stripped from the concrete building sections.

5 Claims, 7 Drawing Figures

APPARATUS FOR MANUFACTURING CONCRETE BUILDING SECTIONS

RELATED APPLICATION

This is a Continuation-In-Part of our U.S. application Ser. No. 623,030, filed Oct. 16, 1975 and now abandoned.

This relates to apparatus for the manufacture of concrete building blocks.

PRIOR ART

It has been suggested to manufacture a plurality of concrete sections using apparatus consisting of a series of molds. However, this previously suggested apparatus is suitable only for production of sections wherein the thickness of the section was relatively great in comparison with the length thereof. The inventors named in the present application have found that construction of concrete structures such as silos is faster and more economical using large concrete sections, that is sections wherein the length is relatively great in comparison with the thickness thereof. However, previously suggested devices for the manufacture of concrete building sections are not suited for the manufacture of substantial quantities of large building sections of uniform thickness. The previously suggested devices are adapted for the manufacture of building blocks in which the walls were relatively thick in comparison with the curved length thereof wherein variations in thickness of the walls over the length thereof are tolerable. However, where concrete building blocks are large that is the curved length is large in comparison with the thickness, variations in thickness of the block are of significance and would detrimentally affect the use of the blocks. It is therefore an object of the present invention to provide an apparatus and method for producing a multiplicity of large curved building sections of uniform thickness. It is also an object of the present invention to provide a novel form for use in such apparatus.

SUMMARY OF THE INVENTION

In accordance with the present invention, there is provided a form for use in molding a plurality of large thin walled curved bodies of uniform wall thickness, said form having a cross section which is substantially cresent shaped.

In accordance with the present invention, there is provided an apparatus for molding a plurality of large curved bodies of substantially uniform thickness comprising a plurality of forms each form having first and second surfaces, said forms being positioned in face to face alignment with said first face of each form being situated adjacent to and spaced from, said second face of an adjacent form, said first surface of each form having a concave curvature with a radius of curvature (a) units, said second surface of each form having a convex curvature with a radius of curvature (b) units, wherein (a) is greater than (b).

The present invention enables a plurality of large thin walled curved bodies of substantially uniform thickness to be produced by aligning in face to face relationship a series of forms having a substantially crescent shaped cross section, releasably fastening said forms to one another by means of end pieces to form a series of open topped cavities for use as molds, filling said molds with concrete, allowing said concrete to set and stripping said forms and end pieces from the concrete.

In the drawings which illustrate embodiments of the invention:

Figure 1:
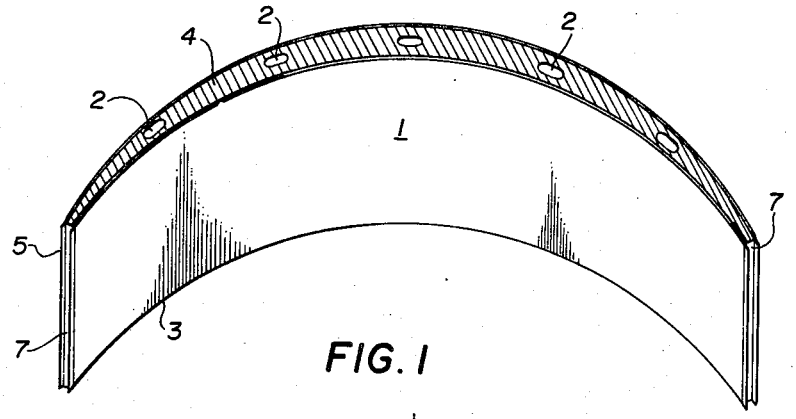
FIG. 1 is an isometric view of a form in accordance with the present invention.
Figure 2:
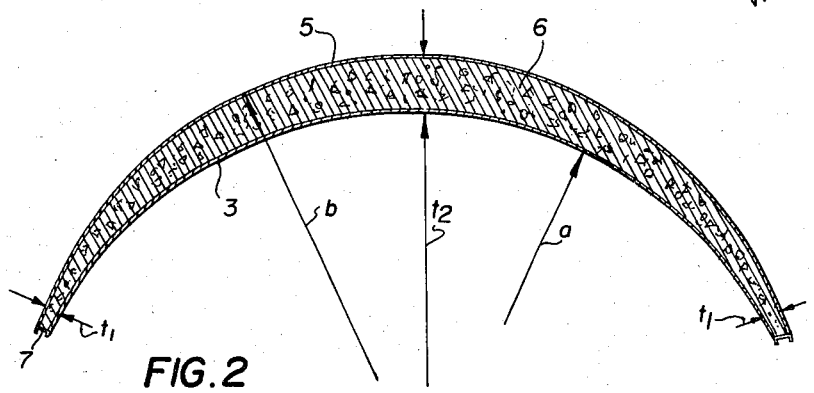
FIG. 2 shows the cross section of the form of FIG. 1 in a plane perpendicular to the longitudinal axis thereof.

Where reference is made herein to building sections which are "large," the applicant is referring to building sections with a cross-section wherein the curved length is large in comparison with the thickness thereof. Referring first to FIG. 1, the form 1, shown therein, comprises an outer metal casing having a cylindrical concave surface 3 and a cylindrical convex surface 5. The form 1 further comprises an inner concrete core 6 the concrete having been introduced by means of openings 2 in the top surface 4 of the casing 1 and allowed to harden. As shown in FIG. 2, the radius of curvature (a) of the concave surface 3 is greater than the radius of curvature (b) of the convex surface 5, as a consequence of which the cross-section of the form in a plane perpendicular to its longitudinal axis is substantially of a crescent shape in that the thickness $t_1$ of the extremities of the cross-section of the form is less than the thickness $t_2$ of the intermediate portion.

Figure 3:
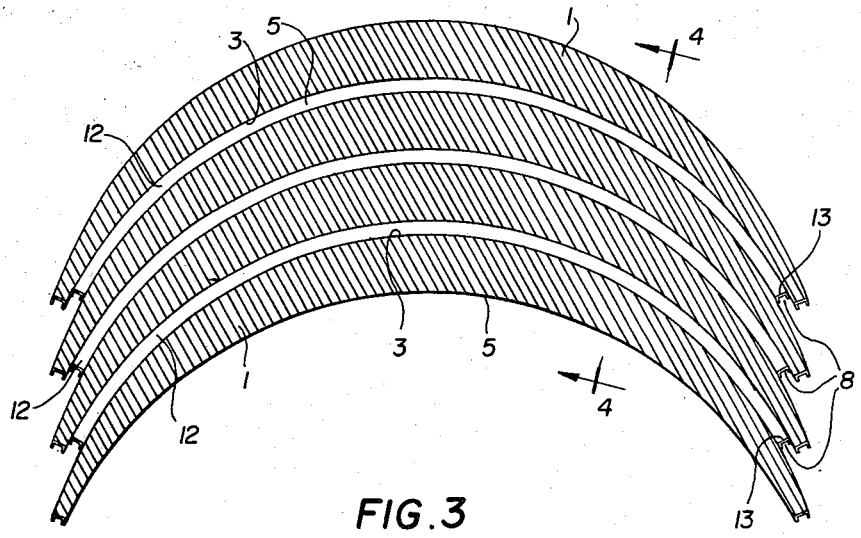
FIG. 3 is a plan view of an assembly comprising a plurality of the forms illustrated in FIG. 1.
Figure 4:
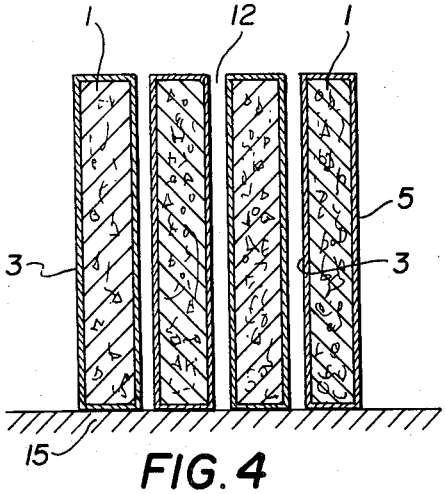
FIG. 4 is a cross sectional view of the assembly shown in FIG. 3 taken along section 4—4.

Referring now to FIGS. 3 and 4, there is shown an assembly of equally spaced substantially identical forms 1 releasably attached together by means of end plates 8, to provide a series of substantially identical open top molds 12, therebetween. The forms 1 are positioned in face to face alignment on a flat surface 15 which forms the bottom wall of the mold. Surface 3 of a first form and surface 5 of an adjacent form together with surfaces 13 of end pieces 8, constitute the four vertical walls of each mold. The forms which are composed of a concrete core with an outer steel casing, are of sufficient rigidity when assembled to support the weight of a concrete truck and to withstand the pressures of the poured concrete in the molds. The outer steel casing further provides a mold surface which is smooth and is not subject to chipping, or cracking unlike a concrete mold without such a casing.

Thus, there are arranged adjacent one another a plurality of forms having first and second surfaces. The forms are releasably connected in alignment, with the first face of each form situated adjacent to and spaced from the second face of an adjacent form. The first surface of each form has a concave curvature with a radius of curvature (a) units. The second surface of each form has a convex curvature with a radius of curvature (b) units, wherein (a) is greater than (b). The forms are spaced from one another to form a mold of constant thickness therebetween. End pieces complete the mold to provide a releasable connection between adjacent forms. It is inherent from the foregoing that the convex surface 5 of one form is spaced from the concave surface 3 of an adjacent form by a distance equal to the thickness T of the slab being produced, and, therefore, as regards each form, the outer radius b is equal to the inner radius a minus the thickness of the concrete section being formed. That is, for each form, $b=a-T$.

The operation for producing the concrete building sections comprises positioning a series of forms in face-to-face relationship on a flat surface. Positioning small molds (not shown) to provide recesses 13 and 14 in the resulting building sections and releasably attaching the forms together by means of end pieces 8 to provide a series of open topped molds 12. Following assembly of the apparatus, the molds are filled with concrete. It has been found that the filling of the molds can be expeditiously carried out by driving a truck carrying the premixed concrete on to the top of the mold assembly. By setting the discharge chute of the truck to correspond with the radius of the molds, each mold can be filled by simply swinging the discharge chute from side to side.

Figure 5:
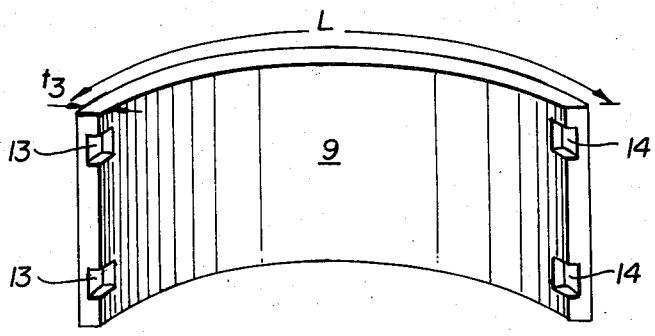
FIG. 5 is an isometric view of the large thin walled concrete section of substantially uniform thickness manufactured using the assembly shown in FIG. 3.

When the concrete has set, the forms 1 and the end pieces 8 are separated from the concrete sections 8, for example, by use of an overhead crane. The resulting building section 9 as shown in FIG. 5 consists of a curved wall having a curved length L units and a substantially uniform thickness $t_3$ units wherein L is large in relation to $t_3$. Sections actually produced in accordance with this invention, have a ratio of L to $t_3$ of 60:1.

Figure 6:
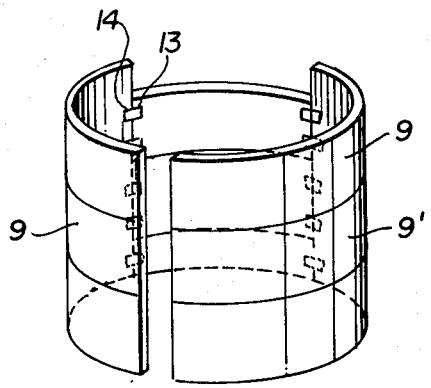
FIG. 6 illustrates a partially completed silo constructed with sections of the type shown in FIG. 5.

FIG. 6 shows a partially assembled silo using building sections 9. As shown in FIG. 6, the silo may be constructed with the building sections 9 assembled in a staggered fashion. To produce the staggered construction, a building section 9' of half the normal height is used as the base of one of the columns of sections. Thereafter, sections 9 of the usual dimensions are used. In assembling the silo, gaskets are positioned between adjacent sections and the sections are linked by means of connectors (not shown) fastened in adjacent recesses 13 and 14.

Figure 7:
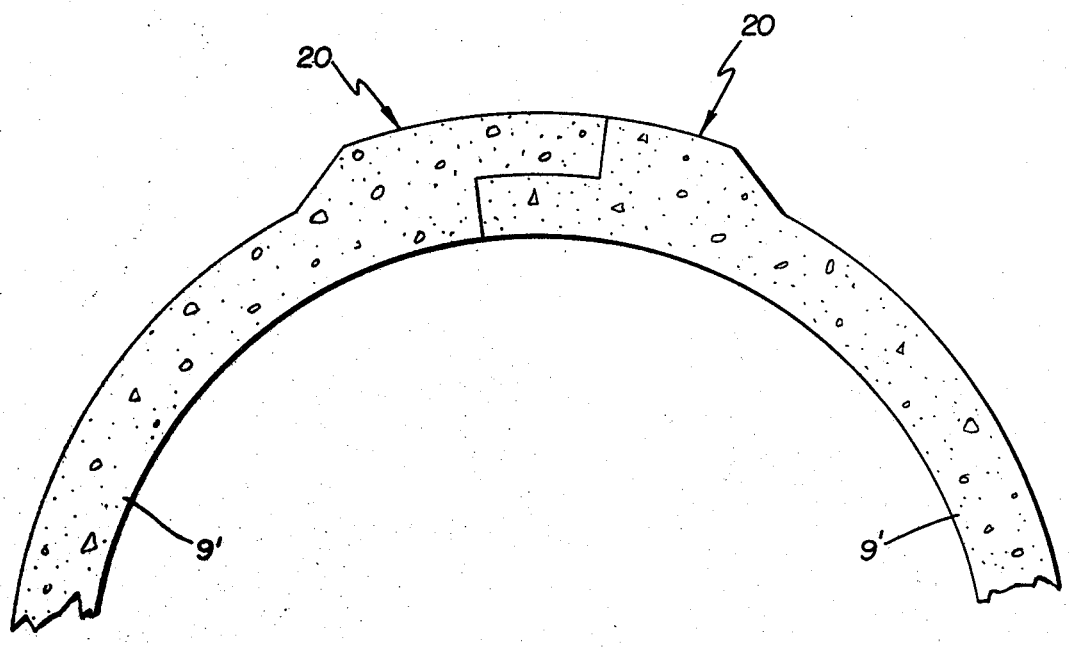
FIG. 7 is a view of the ends of two preferred concrete sections having enlarged end portions.

It is preferable that the ends of each constant-thickness concrete section be of enlarged thickness, as depicted at 20 in forms 9' shown in FIG. 7. Accordingly, the ends of each form are depressed to define concrete portions of increased thickness.

It is also desirable that each form 1 include at least two tapered pins (not shown) projecting from one end thereof in a direction parallel to the longitudinal axis of the form. These pins fit into holes in the floor to assure that the forms are disposed in identical positions whenever they are used.

We claim:

1. Apparatus for molding a plurality of large curved concrete bodies of the same constant thickness comprising, at least three vertically oriented rigid forms each having first and second faces, said forms being releasably connected in alignment whereby said first face of one form is situated adjacent to and horizontally spaced from said second face of an adjacent form, said first face having a transverse concave curvature with a first radius, said second face having a transverse convex curvature with a second radius which is equal to said first radius minus said thickness of said body such that the first face of one form is spaced from the second face of an adjacent form by a distance equal to the thickness of the body, said first radius of each form being equal to the first radius of the other forms and said second radius of each form being equal to the second radius of the other forms.

2. Apparatus according to claim 1, wherein said connected plurality of forms have sufficient structural rigidity to support a concrete mixer truck on top thereof for distributing concrete to the spaces between said forms and to withstand the pressures of the poured concrete in said spaces.

3. Apparatus according to claim 1, wherein said forms comprise a concrete interior and a metal exterior casing.

4. Apparatus according to claim 1, and further including end pieces which complete the mold and provide a releasable connection between adjacent forms.

5. Apparatus according to claim 1, further including means for forming recesses in said bodies such that said bodies may be subsequently joined to one another.

* * * * *